US008316473B2

(12) United States Patent
Freeman

(10) Patent No.: US 8,316,473 B2
(45) Date of Patent: Nov. 27, 2012

(54) TOILET SEAT COVER

(76) Inventor: Jimmy Freeman, Beaumont, TX (US)

( * ) Notice: Subject to any disclaimer, the term of this patent is extended or adjusted under 35 U.S.C. 154(b) by 188 days.

(21) Appl. No.: 12/765,121

(22) Filed: Apr. 22, 2010

(65) Prior Publication Data

US 2011/0258763 A1 Oct. 27, 2011

(51) Int. Cl.
*A47K 13/16* (2006.01)

(52) U.S. Cl. ..... 4/245.9; 4/245.1

(58) Field of Classification Search ..... 4/245.1, 4/245.6–245.9
See application file for complete search history.

(56) References Cited

U.S. PATENT DOCUMENTS 1,036,623 A * 8/1912 Hopkinson ..... 4/245.3
1,863,499 A * 6/1932 Phillips ..... 4/245.3
2,266,990 A * 12/1941 Rea ..... 493/340
D649,626 S * 11/2011 Kim et al. ..... D23/311

* cited by examiner

*Primary Examiner* — Huyen Le
(74) *Attorney, Agent, or Firm* — Jerry D. Haynes; Law Office of Jerry D. Haynes, P.A.

(57) ABSTRACT

The present invention relates to a toilet seat cover for covering and sanitizing a toilet seat comprising: a top edge; a bottom edge; two side edges, where the side edges include two curved portions on each side; and two seat ridge edges above the curved portions, where seat cover includes an antibacterial agent or a disinfectant that allows a user to wipe the seat prior to use. The toilet seat cover according to the present invention may be used to cover a portion of the toilet seat, where the seat cover drapes over a portion of the toilet seat while the bottom end lies within the toilet bowl. The toilet seat cover may be made of a biodegradable material and suitable for flushing into a sewage system.

7 Claims, 1 Drawing Sheet

TOILET SEAT COVER

BACKGROUND OF THE INVENTION

1. Field of Invention

The present invention relates to a toilet seat cover that may be used to cover a portion of a toilet seat to protect against the spread of disease.

2. Description of Related Art

As known and widely used, the toilet is a plumbing fixture that is used to dispose of human waste, specifically urine and fecal matter. The toilet consists of a water tank that allows for the flushing of water into a bowl area that includes a seat to allow the user to sit on the toilet to expel human waste. The use of the toilet is widespread in modern society and many public bathrooms provide toilets in their restrooms.

The use of public toilet seats includes certain drawbacks; in particular control of disease and germs is a paramount concern in public restrooms and especially on or near toilets. To control these diseases or germs that may exist in public toilets frequent cleaning is required. However, the frequency of cleaning may vary and thus may still germ or disease problems may still linger for a user. In addition to providing toilet paper, many public toilets provide toilet seat covers in the form of a disposal piece of paper shaped like a toilet seat. The toilet seat cover is designed to protect the toilet user from germs that may be resting upon the toilet seat. Toilet seat covers may help protect the user from germs or disease that may have accumulated on the seat, however, the toilet cover normally is a dry piece of paper that does not contain any disinfecting materials. It would be advantageous to have a toilet seat cover that includes disinfecting chemicals to provide a means to disinfect the toilet seat that the cover is used thereon. It would also be advantageous to have a toilet seat cover that's easily dispensed and available for use in a public restroom.

SUMMARY OF THE INVENTION

The present invention relates to a toilet seat cover for covering and sanitizing a toilet seat comprising: a top edge; a bottom edge; two side edges, where the side edges include two curved portions on each side; and two seat ridge edges above the curved portions, where seat cover includes an antibacterial agent or a disinfectant that provides a means to wipe the seat prior to use. The toilet seat cover according to the present invention may be used to cover a portion of the toilet seat, where the seat cover drapes over a portion of the toilet seat while the bottom end lies within the toilet bowl. The toilet seat cover may be made of a biodegradable material and suitable for flushing into a sewage system.

DETAILED DESCRIPTION

The present invention provides a toilet seat cover that is useful in protecting a toilet seat and providing a means to clean and sanitize the seat for the user. The toilet seat cover according to the present invention includes an antibacterial towelette that protects a toilet seat, sanitizes the seat for use and then provides protection for the user by preventing direct contact with the toilet seat surface. The toilet seat cover according to the present invention includes antibacterial agents such as alcohol or other disinfecting agents to protect the surface of the toilet seat prior to use by the user. The toilet seat cover is easily dispensed in a conventional toilet paper roller and allows for the covering of a portion of the toilet seat during use.

Figure 1:
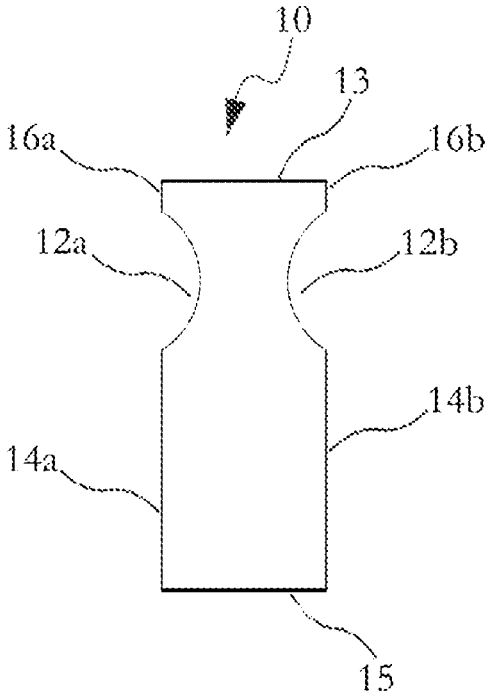
FIG. 1 depicts a toilet seat cover according to the present invention.

FIG. 1 depicts a seat cover 10 according to the present invention. The seat cover 10 is substantially a rectangular towelette that may be dispensed from a roller canister similar to toilet paper. The seat cover 10 includes a top edge 13 and bottom edge 15. The seat cover also has side edges 14*a*, 14*b* which abut two curved portions of 12*a*, 12*b* on each side thereof. The curved portions provide a means to drape the seat cover 10 over a front edge portion of the toilet seat. Further, above the curved portions 12*a*, 12*b*, seat ridge edges 16*a*, 16*b* are provided. The toilet seat cover 10 is a towelette that includes an antibacterial agent or a disinfectant within the towelette that provides a means to wipe the seat prior to use and to place the seat cover in a position that is especially advantageous for protecting male genitalia from touching the toilet.

In one particular embodiment, the seat cover 10 may be four to six inches wide along the bottom edge 15 and have an overall length of about 11 inches. The seat cover 10 drapes over a portion of the toilet seat while the bottom end lies within the toilet bowl. The seat cover 10 is made of a biodegradable material and therefore is suitable for flushing into the sewage system.

Figure 2:
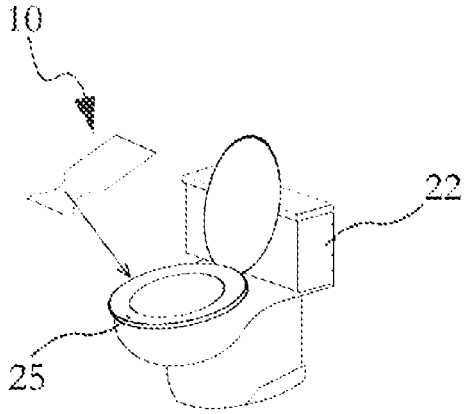
FIG. 2 depicts use of a toilet seat cover according to the present invention placed upon a conventional toilet seat.

FIG. 2 depicts placement of a seat cover 10 onto a toilet seat. A toilet 22 is depicted with a toilet seat 25. As shown in FIG. 2, the toilet seat cover 10 covers a portion of the front edge of the toilet seat and drapes over the toilet seat with use of the ridges edges 16*a*, 16*b*. The curved portions 12*a*, 12*b* abut the top surface of the toilet seat 25. By using this toilet seat cover, a user may have a greater sense of security since the seat may be sanitized prior to use by using the towelette cover seat cover 10.

Figure 3:
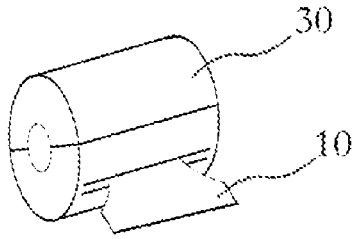
FIG. 3 depicts a dispenser for the toilet seat cover according to the present invention.

The seat cover 10 may be dispensed through a roller canister 30 as shown in FIG. 3. Individual toilet seat covers may be distributed off a roll of toilet seat covers that are pulled and extracted from a rolling canister 30 as depicted in FIG. 3. This allows for convenient placement of the seat cover canister 30 near a toilet and is less cumbersome than the traditional seat cover that is currently used to cover the entire toilet seat. Further, the seat cover 10 according to the present invention includes disinfectant or antibacterial material that allows for the quick wiping of the entire toilet seat to remove germs that may be lingering on the seat prior to use. The instant invention has been shown and described in what it considers to be the most practical and preferred embodiments. It is recognized, however, that departures may be made there from within the scope of the invention and that obvious modifications will occur to a person skilled in the art.

What is claimed is:

1. A toilet seat cover for covering and sanitizing a toilet seat comprising:

a. a top edge draped over a front edge portion of the toilet seat;

b. a bottom edge at an opposing end from the top edge, where the bottom edge rests within a toilet bowl;

c. two side edges, where the side edges include two curved portions on each outer side; and d. two seat ridge edges above the curved portions, where seat cover includes an antibacterial agent or a disinfectant that provides a means to wipe the seat prior to use, where the toilet seat cover hangs over the front edge portion of the toilet seat in a position advantageous for protecting male genitalia from touching the toilet.

2. The toilet seat cover according to claim 1, where the seat cover is made of a biodegradable material and suitable for flushing into a sewage system.

3. The toilet seat cover according to claim 1, where the top edge and bottom edge comprise a width of at least four inches and not greater than six inches, and the side edges comprise a length of eleven inches.

4. The toilet seat cover according to claim 1, where a plurality of toilet seat covers is dispensed from a roller canister.

5. The toilet seat cover according to claim 1, where the top edge, the bottom edge, and the two side edges comprise a generally rectangular shape.

6. A method of use for a toilet seat cover comprising the steps of:

wiping a toilet seat with the toilet seat cover;

draping a front edge of the toilet seat cover over a front portion of a toilet seat; and resting a back edge of the toilet seat cover within a toilet bowl.

7. The method of use for a toilet seat cover according to claim 6 further comprising the step of dispensing the toilet seat cover from a roller canister before use.

* * * * *